US008059986B2

(12) United States Patent
Tanabe et al.

(10) Patent No.: US 8,059,986 B2
(45) Date of Patent: Nov. 15, 2011

(54) CARTRIDGE ASSEMBLING METHOD AND CARTRIDGE REASSEMBLING METHOD

(75) Inventors: Masato Tanabe, Suntou-gun (JP); Kazunari Murayama, Numazu (JP); Hideki Maeshima, Mishima (JP)

(73) Assignee: Canon Kabushiki Kaisha, Tokyo (JP)

( * ) Notice: Subject to any disclaimer, the term of this patent is extended or adjusted under 35 U.S.C. 154(b) by 385 days.

(21) Appl. No.: 12/413,327

(22) Filed: Mar. 27, 2009

(65) Prior Publication Data

US 2009/0245857 A1 Oct. 1, 2009

(30) Foreign Application Priority Data

Mar. 28, 2008 (JP) ..... 2008-086958
Jan. 27, 2009 (JP) ..... 2009-015417

(51) Int. Cl.
*G03G 15/00* (2006.01)

(52) U.S. Cl. ..... 399/109; 399/111; 399/119

(58) Field of Classification Search ..... 399/109, 399/111, 119
See application file for complete search history.

(56) References Cited

U.S. PATENT DOCUMENTS 6,381,430 B1 4/2002 Yokomori
7,162,181 B2 1/2007 Maeshima
2006/0159485 A1 * 7/2006 Nishimura et al. ..... 399/109

FOREIGN PATENT DOCUMENTS

JP 3789122 6/2006

* cited by examiner

*Primary Examiner* — Ryan Walsh
(74) *Attorney, Agent, or Firm* — Canon USA Inc IP Division

(57) ABSTRACT

In a state where a gear is resting on a side cover, the gear and a shaft of a developing roller are made to engage with each other.

11 Claims, 15 Drawing Sheets

CARTRIDGE ASSEMBLING METHOD AND CARTRIDGE REASSEMBLING METHOD

BACKGROUND OF THE INVENTION

1. Field of the Invention

The present invention relates to methods of assembling and reassembling cartridges that can be attached to and removed from bodies of electrophotographic image forming apparatuses.

2. Description of the Related Art

Electrophotographic image forming apparatuses form images on recording media by an electrophotographic image forming method. Examples of such an electrophotographic image forming apparatus include an electrophotographic copier, an electrophotographic printer (a laser beam printer, a light-emitting-diode (LED) printer, and the like), a facsimile apparatus, and a word processor.

Known electrophotographic image forming apparatuses that perform an electrophotographic image forming process include process cartridges that can be attached to and removed from the apparatus bodies. Each process cartridge includes an electrophotographic photoconductor and a processing unit that are integrally formed together. Use of such process cartridges enables users to perform maintenance of the apparatuses for themselves, without the help of servicemen. This has realized a significant improvement in operability. Therefore, process cartridges are widely used for electrophotographic image forming apparatuses.

So far, various methods of assembling and reassembling such process cartridges have been disclosed (see Japanese Patent No. 3789122).

SUMMARY OF THE INVENTION

The present invention is an improvement of the known methods and provides a simple cartridge assembling method and cartridge reassembling method.

According to an aspect of the present invention, a method of assembling a cartridge attachable to and removable from a body of an image forming apparatus is provided. The cartridge includes a developer case having an opening, a rotatable developing roller disposed in the opening and configured to develop a latent image formed on an image bearing member, a bearing disposed on an outer side with respect to the developer case in a longitudinal direction of the developing roller and configured to bear a shaft of the developing roller allowing rotation thereof, a driving force transmitter disposed on the outer side with respect to the bearing in the longitudinal direction and having an engaging portion configured to engage with the shaft of the developing roller so that a force for rotating the developing roller is transmitted to the developing roller, and an end member disposed on the outer side with respect to the driving force transmitter in the longitudinal direction. The method includes resting the driving force transmitter on the end member, the end member staying on the developer case; inserting the shaft of the developing roller into the bearing so that the shaft of the developing roller is supported by the bearing; and engaging the shaft of the developing roller with the driving force transmitter after moving the shaft of the developing roller toward the outer side with respect to the bearing in the longitudinal direction and releasing the driving force transmitter that has been rested on the end member from the end member.

According to another aspect of the present invention, a method of reassembling a cartridge attachable to and removable from a body of an image forming apparatus is provided.

The cartridge includes a developer case having an opening, a rotatable developing roller disposed in the opening and configured to develop a latent image formed on an image bearing member, a bearing disposed on an outer side with respect to the developer case in a longitudinal direction of the developing roller and configured to bear a shaft of the developing roller allowing rotation thereof, a driving force transmitter disposed on the outer side with respect to the bearing in the longitudinal direction and having an engaging portion configured to engage with the shaft of the developing roller so that a force for rotating the developing roller is transmitted to the developing roller, and an end member disposed on the outer side with respect to the driving force transmitter in the longitudinal direction. The method includes removing the shaft of the developing roller from the bearing with the end member staying on the developer case; resting the driving force transmitter on the end member, the end member staying on the developer case; inserting the shaft of the developing roller or a shaft of another developing roller into the bearing so that the shaft of the developing roller or the shaft of the another developing roller is supported by the bearing; and engaging the shaft of the developing roller or the shaft of the another developing roller with the driving force transmitter after moving the shaft of the developing roller or the shaft of the another developing roller toward the outer side with respect to the bearing in the longitudinal direction and releasing the driving force transmitter that has been rested on the end member from the end member.

Further features of the present invention will become apparent from the following description of exemplary embodiments with reference to the attached drawings.

DESCRIPTION OF THE EMBODIMENTS

Overall Configuration of Image Forming Apparatus

Figure 1:
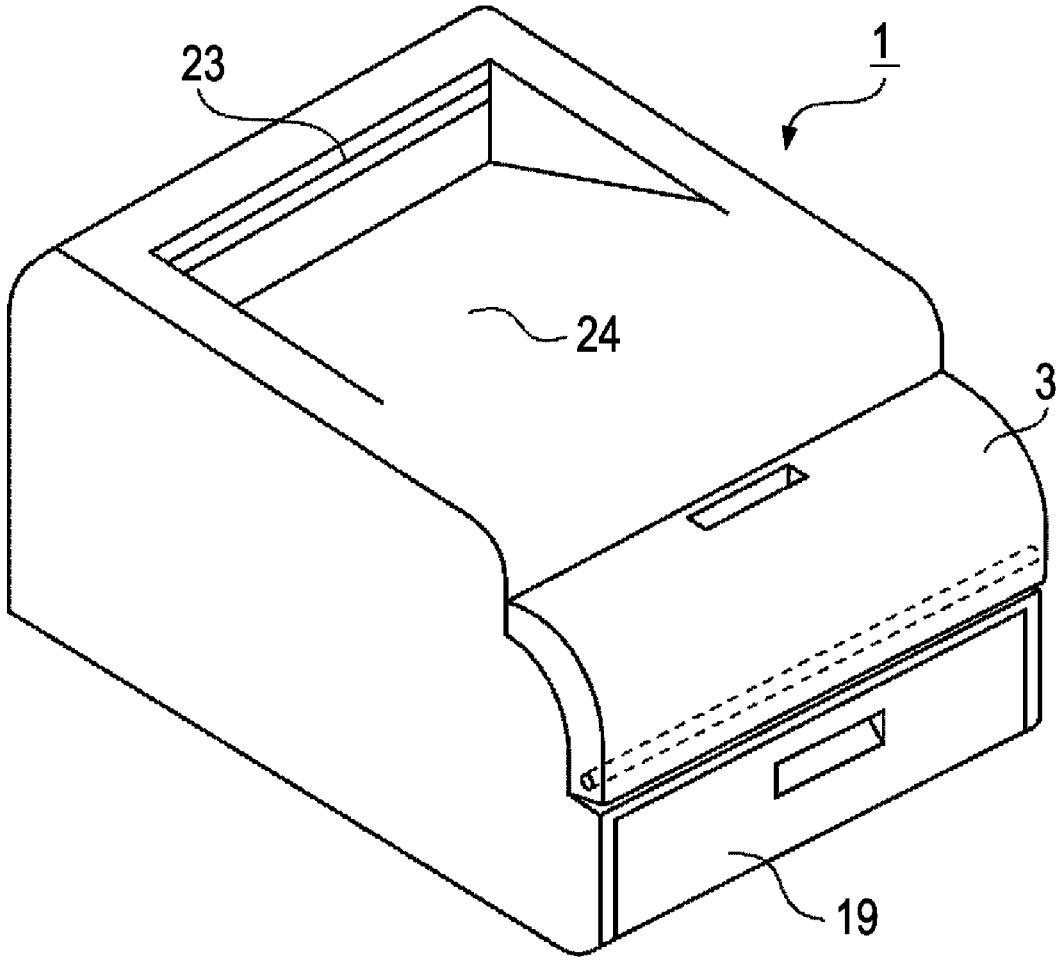
FIG. 1 is an external perspective view of an image forming apparatus.
Figure 2:
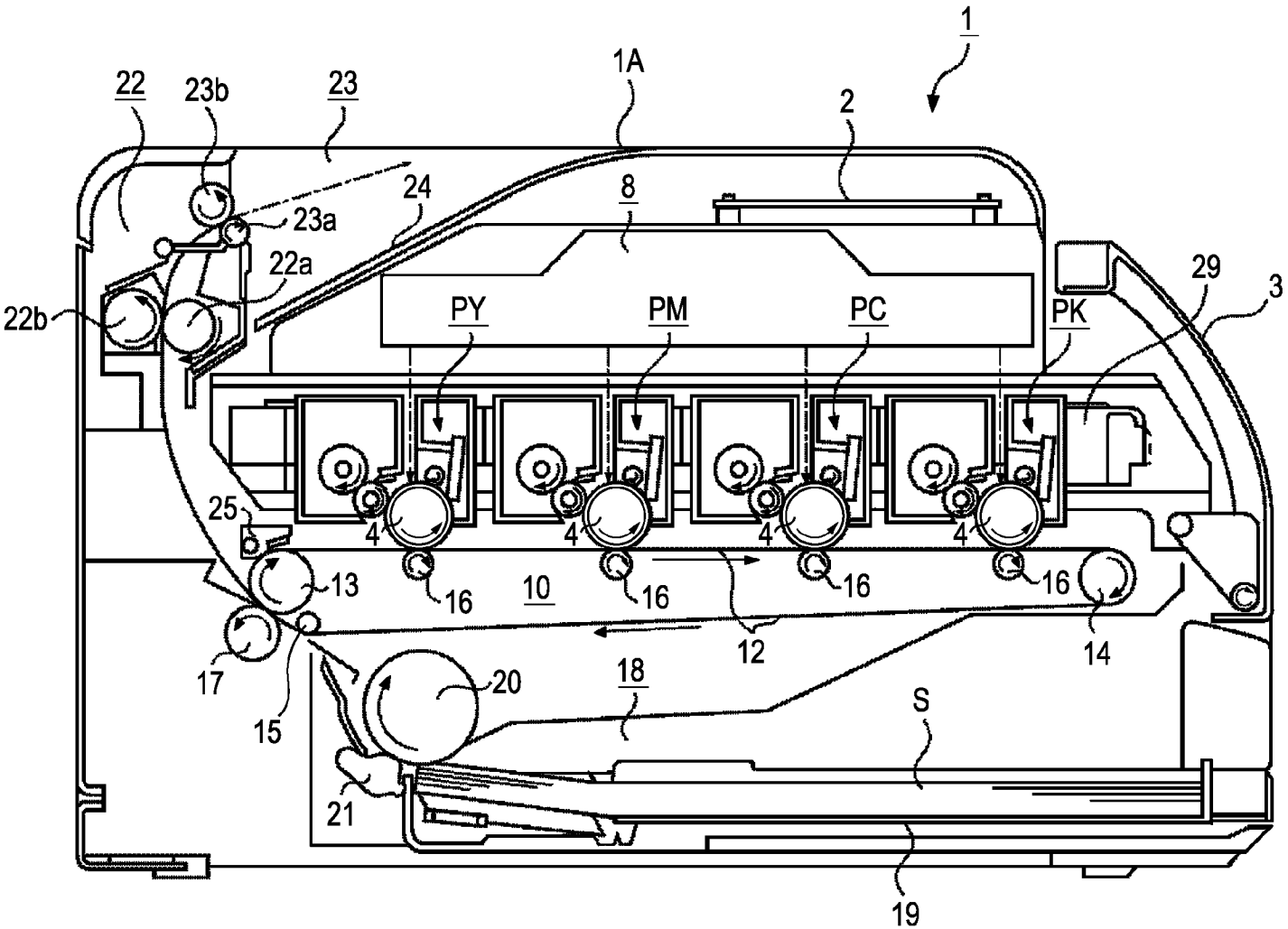
FIG. 2 is a longitudinal sectional left side view of the image forming apparatus.
Figure 3:
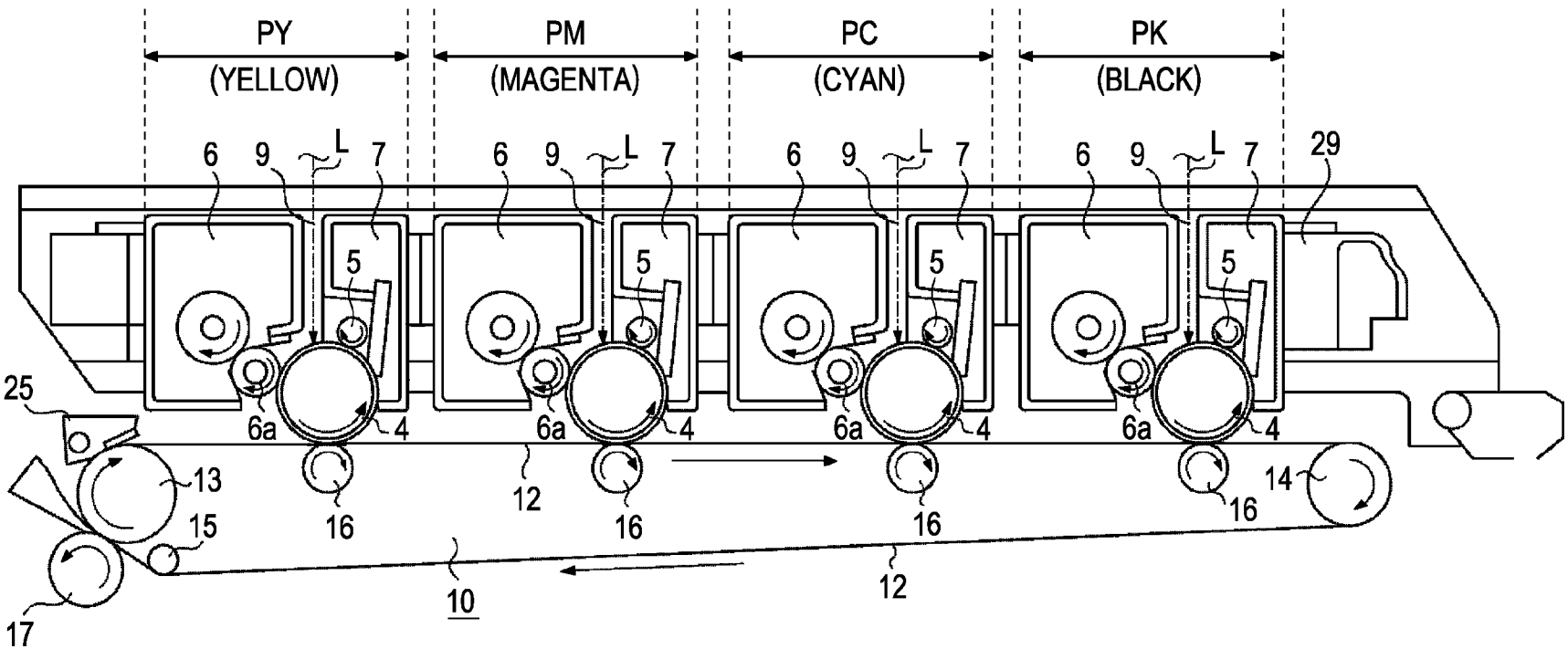
FIG. 3 is an enlarged view of relevant elements shown in FIG. 2.

FIG. 1 is an external perspective view of a color electrophotographic image forming apparatus 1 according to an embodiment of the present invention. FIG. 2 is a longitudinal sectional left side view of the image forming apparatus 1. FIG. 3 is an enlarged view of relevant elements shown in FIG. 2.

The image forming apparatus 1 is a four-full-color laser printer that performs an electrophotographic process. The image forming apparatus 1 forms an image on a recording medium (such as a paper sheet, an over-head-projector (OHP) sheet, a label sheet) S in accordance with electrical signals that are input to a control portion (control circuit board) 2 thereof from an external host apparatus (not shown), such as a personal computer or an image reader.

Hereinafter, the following directional references are used. The front side of the image forming apparatus 1 refers to a side having a body door 3. The rear side refers to a side opposite the front side. The anteroposterior direction refers to a forward direction from the rear side toward the front side of an apparatus body 1A and a backward direction opposite thereto. The left and the right refer to the left side and the right side, respectively, of the body 1A seen from the front side. The horizontal direction refers to a direction from the right toward the left (a leftward direction) or a direction opposite thereto (a rightward direction).

Two ends of an electrophotographic photoconductive drum in the longitudinal direction (axial direction) thereof are referred to as a drive side and a nondrive side, respectively.

The body 1A of the image forming apparatus 1 houses, in order from the rear side to the front side, first to fourth process cartridges PY, PM, PC, and PK each extending horizontally (in the lateral direction) and arranged parallel to each other (such an arrangement is called an inline tandem arrangement). The process cartridges PY, PM, PC, and PK have a common electrophotographic processing mechanism, except that they contain different colors of toner, and can be attached to and removed from the body 1A.

The process cartridges PY, PM, PC, and PK of the embodiment are each an assembly including a cleaner unit (a first frame) and a developer unit (a second frame) 6. The cleaner unit includes an electrophotographic photoconductive drum 4 serving as an image bearing member, and a charger 5 and a cleaning member 7 serving as processing members that perform respective processings on the drum 4. The developer unit 6 includes a developer serving as a processing member. The charger 5 is a charging roller. The cleaning member 7 is a cleaning blade. The developer is a developing roller 6*a*.

The first process cartridge PY contains in a developer case thereof yellow (Y) toner, and a Y-color toner image is formed on the drum 4 thereof. The second process cartridge PM contains in a developer case thereof magenta (M) toner, and an M-color toner image is formed on the drum 4 thereof. The third process cartridge PC contains in a developer case thereof cyan (C) toner, and a C-color toner image is formed on the drum 4 thereof. The fourth process cartridge PK contains in a developer case thereof black (K) toner, and a K-color toner image is formed on the drum 4 thereof.

A laser scanner unit 8 is disposed above the process cartridges PY, PM, PC, and PK. The scanner unit 8 emits laser light L modulated in accordance with image information for the individual colors inputted from the external host apparatus to the control portion 2. The laser light L passes through exposure windows 9 provided on the top surfaces of the process cartridges PY, PM, PC, and PK, and is moved so as to scanningly expose the surfaces of the drums 4 in the respective process cartridges PY, PM, PC, and PK.

An intermediate transfer belt unit 10 serving as a transfer member is disposed below the process cartridges PY, PM, PC, and PK. The unit 10 includes an endless belt 12 serving as a transfer belt and having flexibility, and a driving roller 13, a driven roller 14, and a tension roller 15 around which the belt 12 is stretched and rotated. The driving roller 13 and the tension roller 15 are disposed on the rear side in the body 1A. The driven roller 14 is disposed on the front side in the body 1A. The drums 4 of the process cartridges PY, PM, PC, and PK have the bottom surfaces thereof be in contact with the top surface of the belt 12, whereby primary transfer nips are formed. Primary transfer rollers 16 are disposed on the upper inner periphery of the belt 12 in such a manner as to face the respective drums 4 of the process cartridges PY, PM, PC, and PK. The driving roller 13 is in contact with a secondary transfer roller 17 with the belt 12 interposed therebetween.

A sheet feeding unit 18 is disposed below the intermediate transfer belt unit 10. The unit 18 includes a sheet tray 19, a feeding roller 20, a separating pad 21, and so forth. The sheet tray 19, which is of front loading type, can be loaded and unloaded from the front side of the body 1A.

A fusing unit 22 and a sheet discharge unit 23 are disposed on the upper rear side in the body 1A. The top surface of the body 1A forms a discharge tray 24. The fusing unit 22 includes a fusing film assembly 22*a* and a pressing roller 22*b*. The sheet discharge unit 23 includes a driving roller 23*a* and a driven roller 23*b*.

The process cartridges PY, PM, PC, and PK mounted at the respective positions in the body 1A are pressed from above by a process cartridge pressing mechanism, which will be described separately below, thereby held in such a manner as to be positioned and secured by positioning members of the body 1A. The process cartridges PY, PM, PC, and PK have driving-force-inputting portions connected to driving-force-outputting portions of the body 1A. The process cartridges PY, PM, PC, and PK also have input electrical contacts electrically connected to a power feeding system housed in the body 1A.

A full-color image is formed in the following manner. The drums 4 of the first to fourth process cartridges PY, PM, PC, and PK are driven to rotate counterclockwise, as indicated by the arrows in FIG. 2, at a predetermined speed. Simultaneously, the belt 12 is driven to rotate clockwise, as indicated by the arrows in FIG. 2, following the rotation of the drums 4, at a speed corresponding to the speed at which the drums 4 rotate. The scanner unit 8 is also driven at this time. Synchronously with these driving operations, the charging rollers 5 of the process cartridges PY, PM, PC, and PK charge the surfaces of the drums 4 with a predetermined uniform polarity and potential and with individually predetermined control timings. The scanner unit 8 scanningly moves the laser light L modulated in accordance with image signals for the respective colors, thereby exposing the surfaces of the drums 4. Thus, electrostatic latent images are formed on the surfaces of the drums 4 in accordance with the image signals for the respective colors. The electrostatic latent images are developed as toner images by the developer unit 6.

As a result of the electrophotographic image forming process described above, a Y-color toner image corresponding to the yellow component of the full-color image is formed on the drum 4 of the first process cartridge PY, and is subjected to primary transfer onto the belt 12.

An M-color toner image corresponding to the magenta component of the full-color image is formed on the drum 4 of the second process cartridge PM, and is subjected to primary transfer onto the belt 12 in such a manner as to be superposed on the Y-color toner image.

A C-color toner image corresponding to the cyan component of the full-color image is formed on the drum 4 of the third process cartridge PC, and is subjected to primary transfer onto the belt 12 in such a manner as to be superposed on the (Y+M)-color toner image.

A K-color toner image corresponding to the black component of the full-color image is formed on the drum 4 of the fourth process cartridge PK, and is subjected to primary transfer onto the belt 12 in such a manner as to be superposed on the (Y+M+C)-color toner image.

Thus, a four-full-color, or (Y+M+C+K)-color, unfused toner image is formed on the belt 12.

The post-transfer toner remaining on the surfaces of the drums 4 in the process cartridges PY, PM, PC, and PK after the primary transfer of the toner images onto the belt 12 is removed by the cleaning blades 7.

Meanwhile, the feeding roller 20 is driven with a predetermined control timing. In response to this, the feeding roller 20 and the separating pad 21 work in combination in such a manner as to separate one of the sheets S stacked on the sheet tray 19 from the other, and the sheet S is fed into a nip (secondary transfer nip) between the secondary transfer roller 17 and the belt 12. While the sheet S is nipped and conveyed through the nip, the toner images of four colors superposed one on top of another on the belt 12 are transferred at a time onto the sheet S.

Subsequently, the sheet S is separated from the belt 12, is guided to the fusing unit 22, and is heated and pressed at a fusing nip, whereby the toner images of the four colors are fused together and fixed on the sheet S. The sheet S that has passed through the fusing unit 22 is discharged as a piece of full-color-image-printed matter by the sheet discharge unit 23 onto the discharge tray 24.

The post-secondary-transfer toner remaining on the belt 12 after the sheet S is separated therefrom is removed by a belt cleaner 25. The belt 12 can be cleaned without the belt cleaner 25 if, for example, the post-secondary-transfer toner is made to electrostatically adhere to the surface of the drum 4 of the first process cartridge PY at the corresponding primary transfer nip and to be removed by the cleaning blade 7 thereof.

Process Cartridge

In the embodiment, the first to fourth process cartridges PY, PM, PC, and PK all have the same configuration. The configuration of one of the process cartridges, hereinafter denoted by P, will be described with reference to FIGS. 4 to 6.

Figure 4:
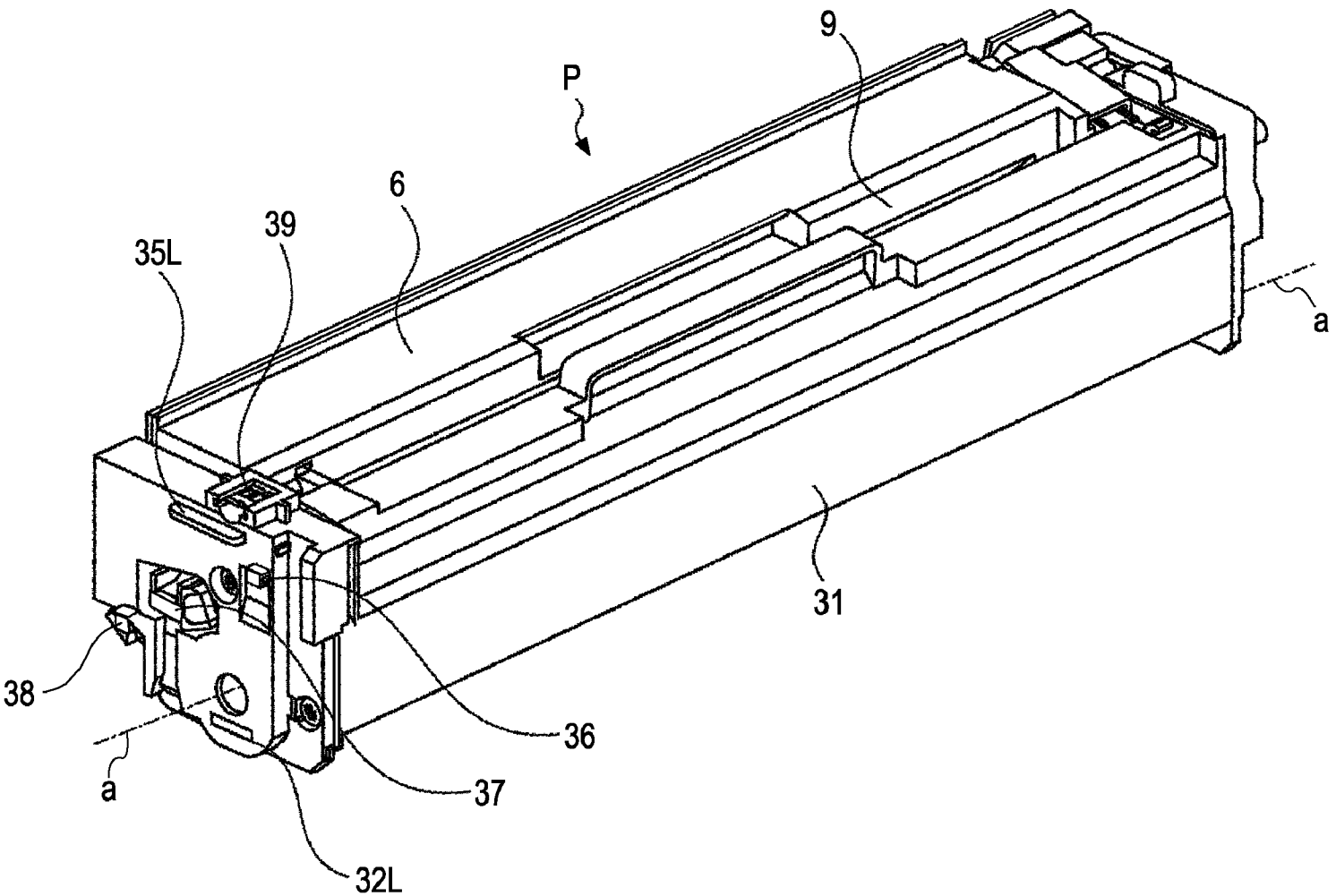
FIG. 4 is a perspective view showing the entirety of a process cartridge.
Figure 5:
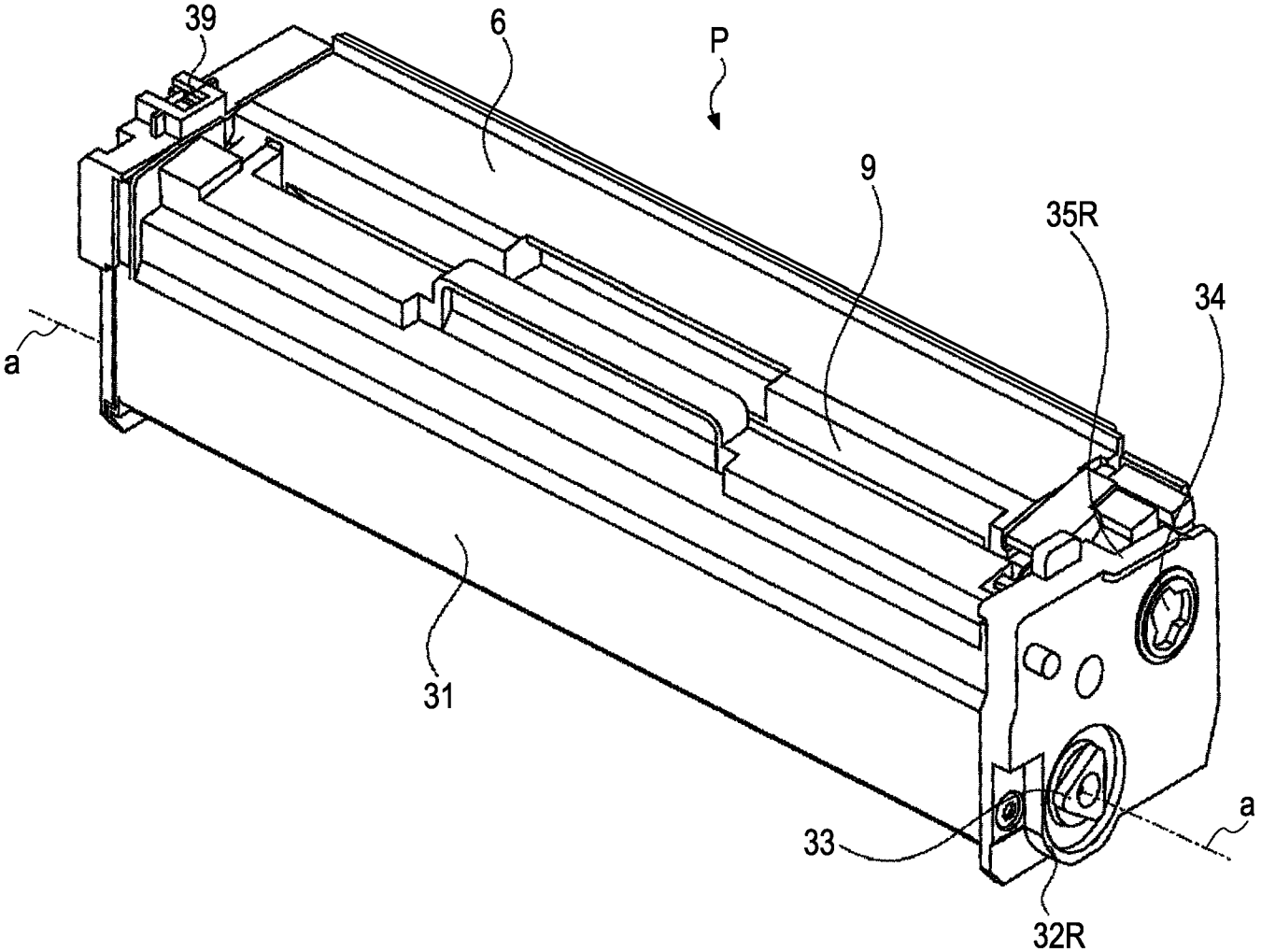
FIG. 5 is another perspective view showing the entirety of the process cartridge.
Figure 6:
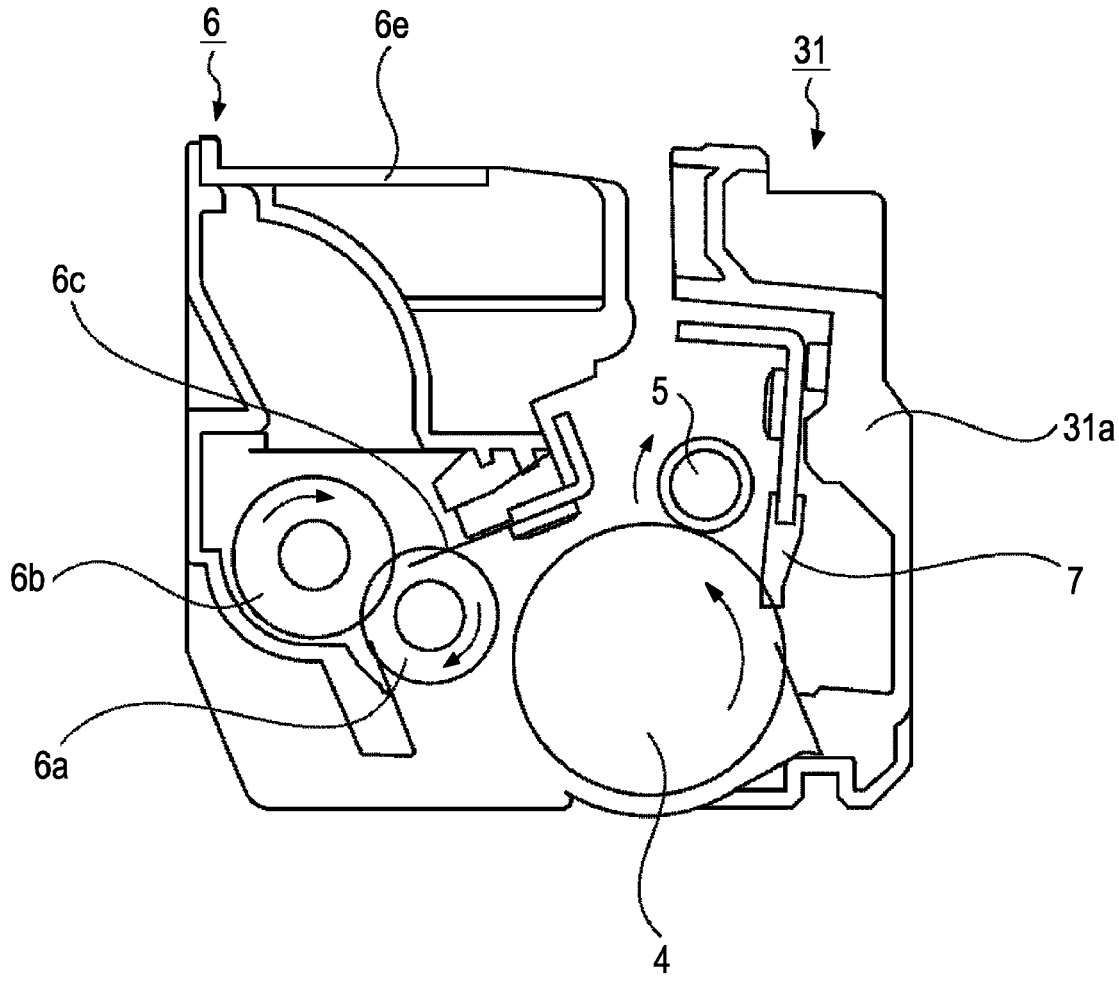
FIG. 6 is a cross-sectional view showing the configuration of the process cartridge.

FIG. 4 is a perspective view of the process cartridge P seen from the nondrive side. FIG. 5 is a perspective view of the process cartridge P seen from the drive side. FIG. 6 is a cross-sectional left side view of the process cartridge P.

The process cartridge P is a horizontally extending assembly having a large length in the horizontal direction, shown as an axial direction a-a of the drum 4, and includes the cleaner unit (the first frame), hereinafter denoted by 31, and the developer unit (the second frame) 6.

Referring to FIG. 6, the cleaner unit 31 includes a cleaner case (cleaner frame) 31*a*, which houses the drum 4, the charging roller 5, and the cleaning blade 7. The drum 4 is rotatably provided in the cleaner case 31*a* between left and right side boards thereof, with a nondrive-side bearing 32L and a drive-side bearing 32R interposed therebetween. The charging roller 5 extending parallel to the drum 4 is in contact with the drum 4, and is rotatably provided in the cleaner case 31*a* between the left and right side boards, with bearings interposed therebetween. The cleaning blade 7 is an elastic rubber blade whose base is secured to the cleaner case 31*a*. The cleaning blade 7 is in contact with the drum 4 with the edge thereof oriented opposite to the rotating direction of the drum 4. The cleaning blade 7 removes the post-transfer toner remaining on the drum 4. The toner removed from the drum 4 by the cleaning blade 7 is received by the cleaner case 31*a*.

The developer unit 6 includes the developer case (developer frame), hereinafter denoted by 6*e*. The developer case 6*e* houses the developing roller 6*a* and a toner applying roller 6*b* that are rotatable, and a toner-amount-regulating member (developer blade) 6*c*. The developer case 6*e* contains toner (not shown). The developing roller 6*a* is an elastic rubber roller and is rotatably provided in the developer case 6*e* between left and right side boards thereof, with bearings interposed therebetween. The toner applying roller 6*b*, configured to apply the toner to the developing roller 6*a*, extends parallel to the developing roller 6*a* and is in contact with the developing roller 6*a*. The toner applying roller 6*b* is rotatably provided in the developer case 6*e* between the left and right side boards, with bearings interposed therebetween. The toner-amount-regulating member 6*c* is an elastic thin plate whose base is secured to the developer case 6*e*. The toner-amount-regulating member 6*c* is disposed on the downstream side with respect to the toner applying roller 6*b* in a direction in which the developing roller 6*a* rotates. Part of one surface of the toner-amount-regulating member 6*c* is in contact with the developing roller 6*a* with the edge thereof oriented opposite to the rotating direction of the developing roller 6*a*. The toner-amount-regulating member 6*c* regulates the amount of toner applied to the developing roller 6*a* by the toner applying roller 6*b* so as to have a specific thickness, while giving the toner a predetermined amount of charge.

The process cartridge P has on the drive side thereof a drum drive coupling (drum-driving-force receiver) 33, a developer drive coupling (developing-roller-driving-force receiver) 34, and a drive-side catch 35R. The catch 35R is provided on the upper side of the process cartridge P. The drum drive coupling 33 is disposed coaxially with the drum 4. In a state where the process cartridge P is mounted on the apparatus body 1A, the drum drive coupling 33 receives a driving force for rotating the drum 4 applied by a relevant element in the body 1A, and the developer drive coupling 34 receives a driving force for rotating the developing roller 6*a* and the toner applying roller 6*b* applied from a relevant element in the body 1A. The catch 35R provided on the upper side of the process cartridge P catches a tray 29, whereby the process cartridge P can be supported by the tray 29. When the process cartridge P is mounted on the body 1A, the drive-side bearing 32R engages with a drive-side positioning member of the body 1A, thereby serving as a drive-side supported portion at which the process cartridge P is positioned. The supported portion, i.e., the bearing 32R, is provided on the lower side of the process cartridge P.

The process cartridge P has on the nondrive side thereof a nondrive-side catch 35L. The catch 35L catches the tray 29 in combination with the catch 35R, whereby the process cartridge P is supported by the tray 29. The catch 35L is provided on the upper side of the process cartridge P. When the process cartridge P is mounted on the body 1A, the nondrive-side bearing 32L engages with a nondrive-side positioning member of the body 1A, thereby serving as a nondrive-side supported portion at which the process cartridge P is positioned. The supported portion, i.e., the bearing 32L, is provided on the lower side of the process cartridge P.

When the process cartridge P is mounted on the body 1A, the drum drive coupling 33 and the developer drive coupling 34 respectively engage with a first driving-force-outputting portion (not shown) and a second driving-force-outputting portion (not shown) provided on the body 1A. The first driving-force-outputting portion transmits a driving force to the drum drive coupling 33, whereby the drum 4 is driven to rotate counterclockwise, in FIG. 6, at a predetermined speed. The charging roller 5 rotates following the rotation of the drum 4.

The second driving-force-outputting portion transmits a driving force to the developer drive coupling 34. The developer drive coupling 34 has multiple gears (not shown) provided coaxially as an integral body and meshing in series with driving gears (not shown) configured to drive the developing roller 6*a* and the toner applying roller 6*b*, respectively. To rotate the developing roller 6*a* and the toner applying roller 6*b* clockwise in FIG. 6, a counterclockwise rotational driving force in FIG. 6 is applied to the developer drive coupling 34 via the second driving-force-outputting portion of the body 1A.

The toner contained in the developer case 6*e* is applied to the developing roller 6*a* when the toner applying roller 6*b* is driven to rotate. The toner applied to the developing roller 6*a* is regulated to have a specific thickness and is charged by the toner-amount-regulating member 6*c*. With the rotation of the developing roller 6*a*, the toner is conveyed to a developing site, i.e., a contact portion between the developing roller 6*a* and the drum 4, and is used for development of the latent image on the drum 4. With further rotation of the developing roller 6*a*, the post-development toner remaining on the developing roller 6*a* is conveyed back to the internal space of the developer case 6*e*, and is removed from the developing roller 6*a* by the toner applying roller 6*b*. Simultaneously with the removal of the remaining toner, fresh toner is applied to the developing roller 6*a* by the toner applying roller 6*b*.

The process cartridge P has on the left side, i.e., the nondrive-side surface, thereof first to fourth electrical contacts 36 to 39. The first electrical contact 36 is electrically connected to the charging roller 5, thereby receiving from a relevant element in the body 1A a charge bias to be supplied to the charging roller 5. The second electrical contact 37 is electrically connected to the developing roller 6*a*, thereby receiving from a relevant element in the body 1A a development bias to be supplied to the developing roller 6*a*. The third electrical contact 38 is electrically connected to the toner applying roller 6*b*, thereby receiving from a relevant element in the body 1A an application bias to be supplied to the toner applying roller 6*b*. The fourth electrical contact 39 has a memory and is electrically connected to the control portion 2 in the body 1A, enabling communication between the control portion 2 and the memory.

The first and second electrical contacts 36 and 37 are exposed on the left side of the process cartridge P. The third electrical contact 38 is exposed at an edge of the process cartridge P in a direction in which the tray 29 moves from the outer side toward the inner side of the body 1A. The fourth electrical contact 39 is exposed on the nondrive-side upper surface of the process cartridge P.

Configuration of Developer Unit

The configuration of the developer unit 6 included in the process cartridge P will be described with reference to FIGS. 9 to 12.

Figure 9:
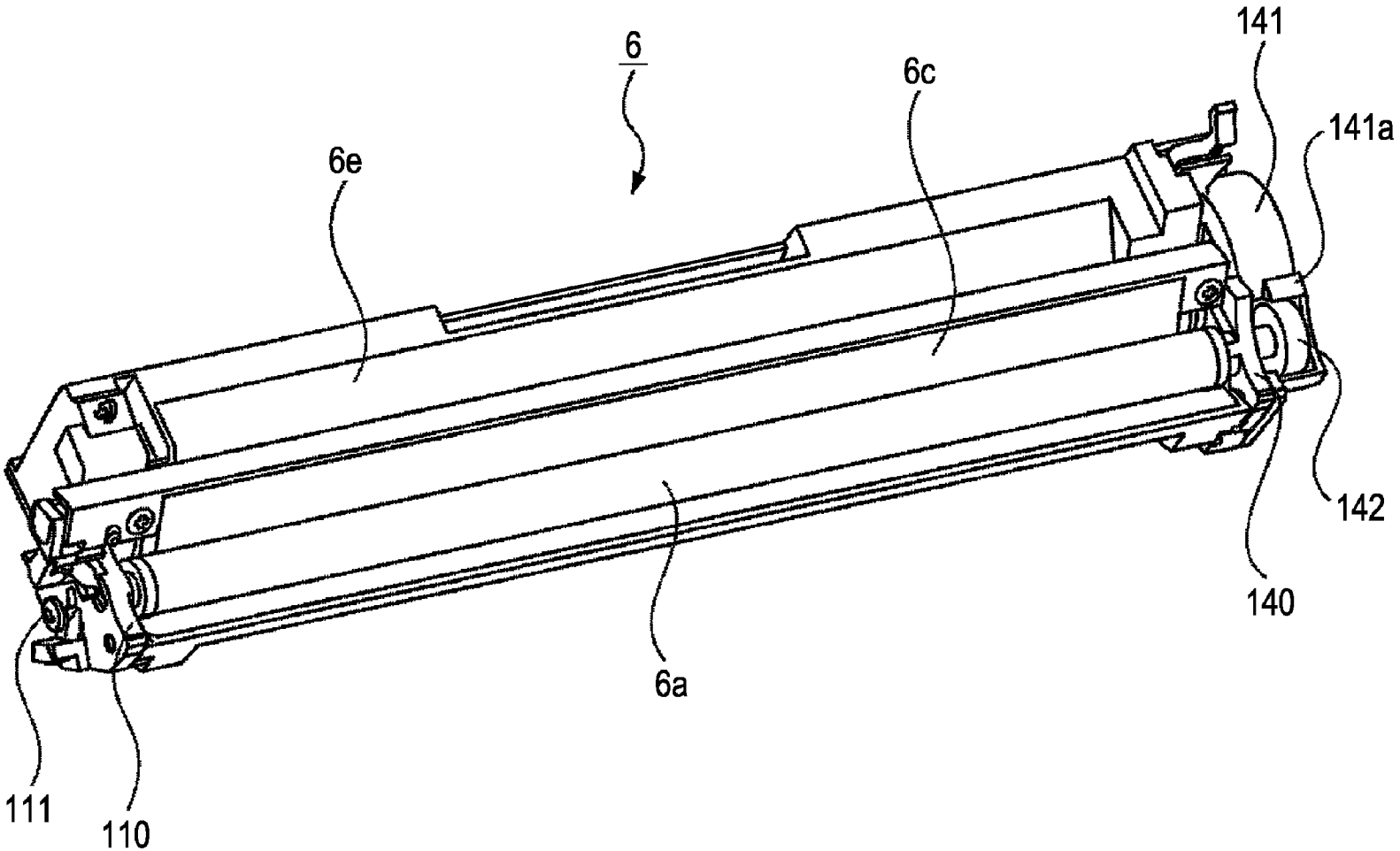
FIG. 9 is a perspective view showing the entirety of a developer unit.
Figure 10:
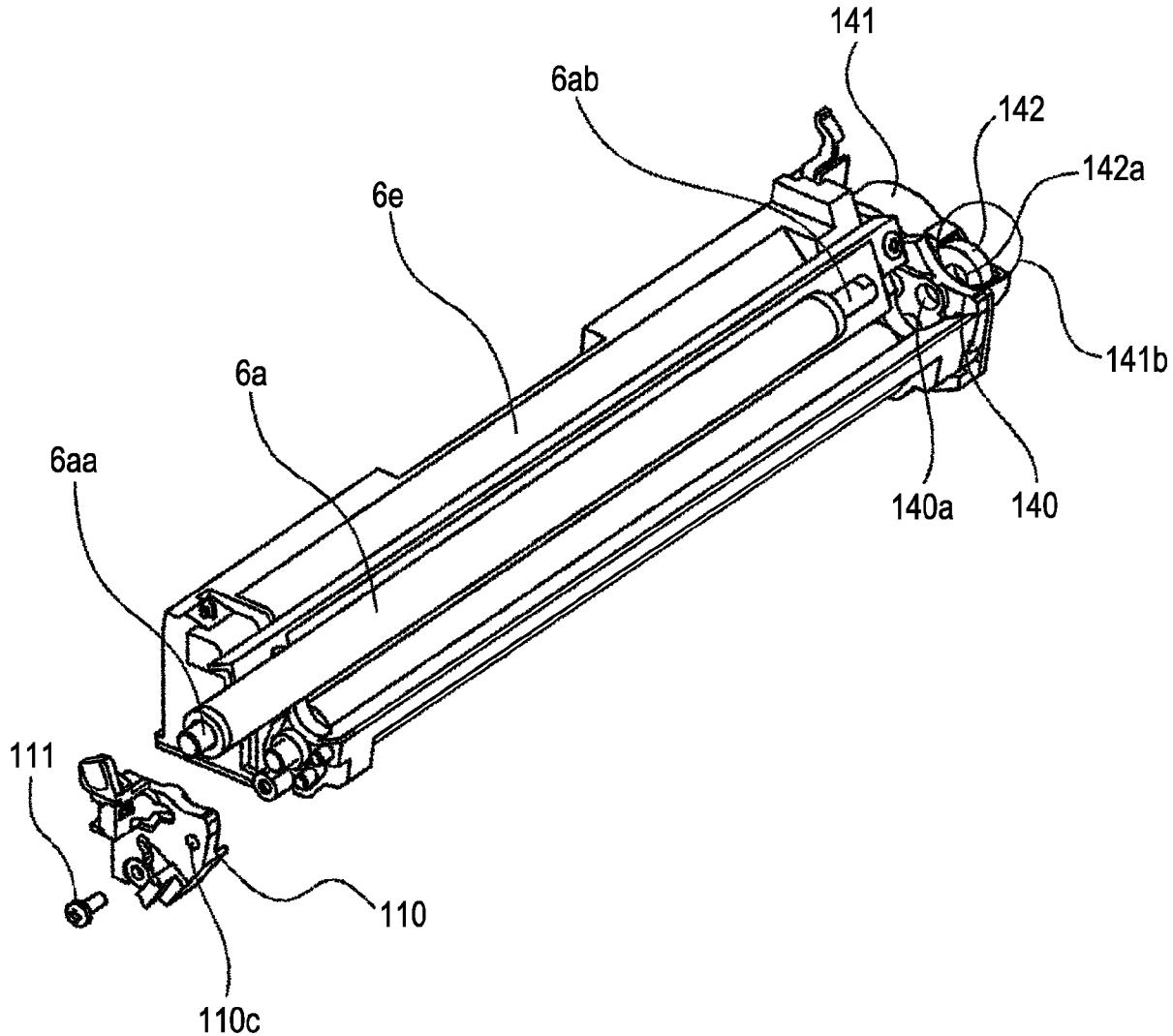
FIG. 10 is an exploded perspective view showing how a bearing and a developing roller are disassembled from the developer unit.
Figure 11:
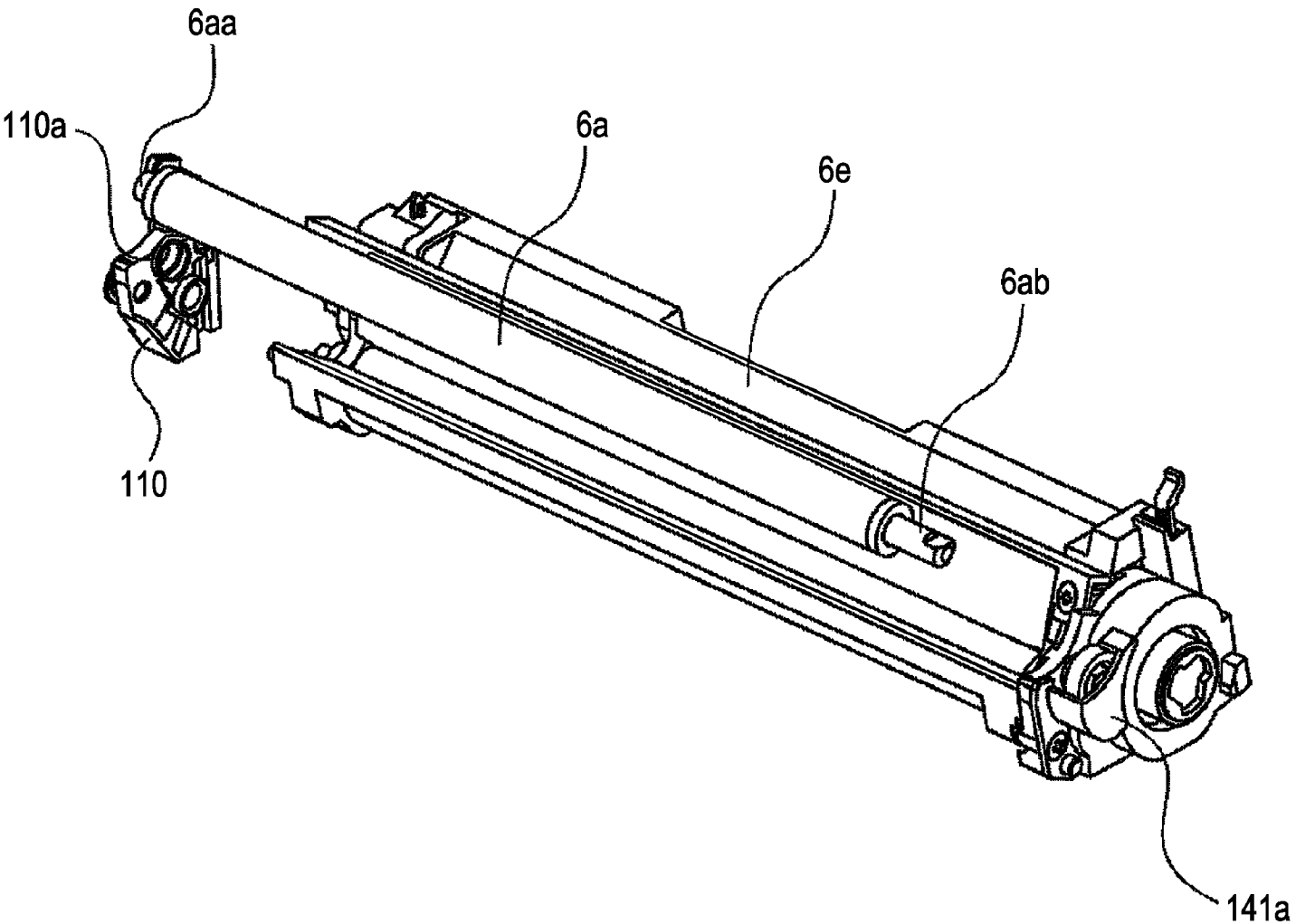
FIG. 11 is another exploded perspective view showing how the bearing and the developing roller are disassembled from the developer unit.
Figure 12:
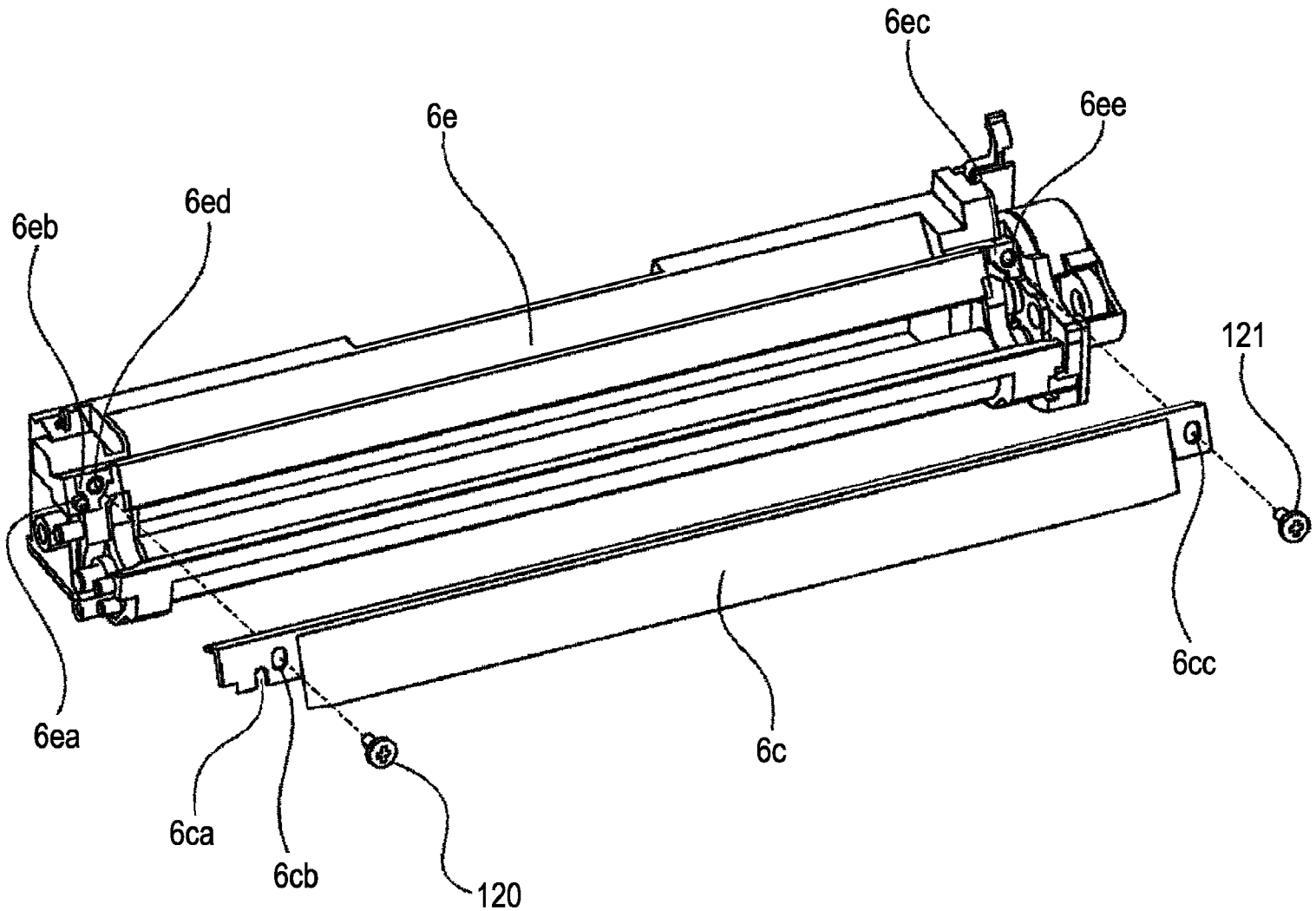
FIG. 12 is an exploded perspective view showing how a toner-amount-regulating member is disassembled from the developer unit.

FIG. 9 is a schematic perspective view showing the overall configuration of the developer unit 6. FIGS. 10 and 11 are exploded perspective views of the developer unit 6 seen from the nondrive side and the drive side, respectively, with a nondrive-side bearing 110 and the developing roller 6*a* disassembled from the developer unit 6. FIG. 12 is an exploded perspective view of the developer unit 6, with the toner-amount-regulating member 6*c* disassembled from the developer unit 6.

Major elements of the developer unit 6 include the developer case 6*e*, and the nondrive-side bearing 110 and a drive-side bearing 140 provided at respective ends of the developer case 6*e* and supporting the developing roller 6*a* and the toner applying roller 6*b* allowing rotations thereof. The developing roller 6*a* is disposed in a toner filling opening 6*m* (see FIG. 13). More specifically, the bearing 110 has a hole 110*a*, and the bearing 140 has a hole 140*a*. The holes 110*a* and 140*a* serve as bearings configured to bear a nondrive-side shaft 6*a* a and a drive-side shaft 6*ab*, respectively, of the developing roller 6*a*. The process cartridge P also has on the drive side thereof a side cover 141 serving as an end member, and a series of gears (some of the gears are not shown) configured to receive a driving force from a relevant element in the body 1A and to drive the developing roller 6*a* and the toner applying roller 6*b*.

The toner-amount-regulating member 6*c* is secured to the developer case 6*e* at the nondrive-side end and the drive-side end thereof, with screws 120 and 121 respectively screwed into toner-amount-regulating-member-securing holes 6*ed* and 6*ee* provided in toner-amount-regulating-member-bearing surfaces 6*eb* and 6*ec*.

Unit Disassembling Step

Figure 7:
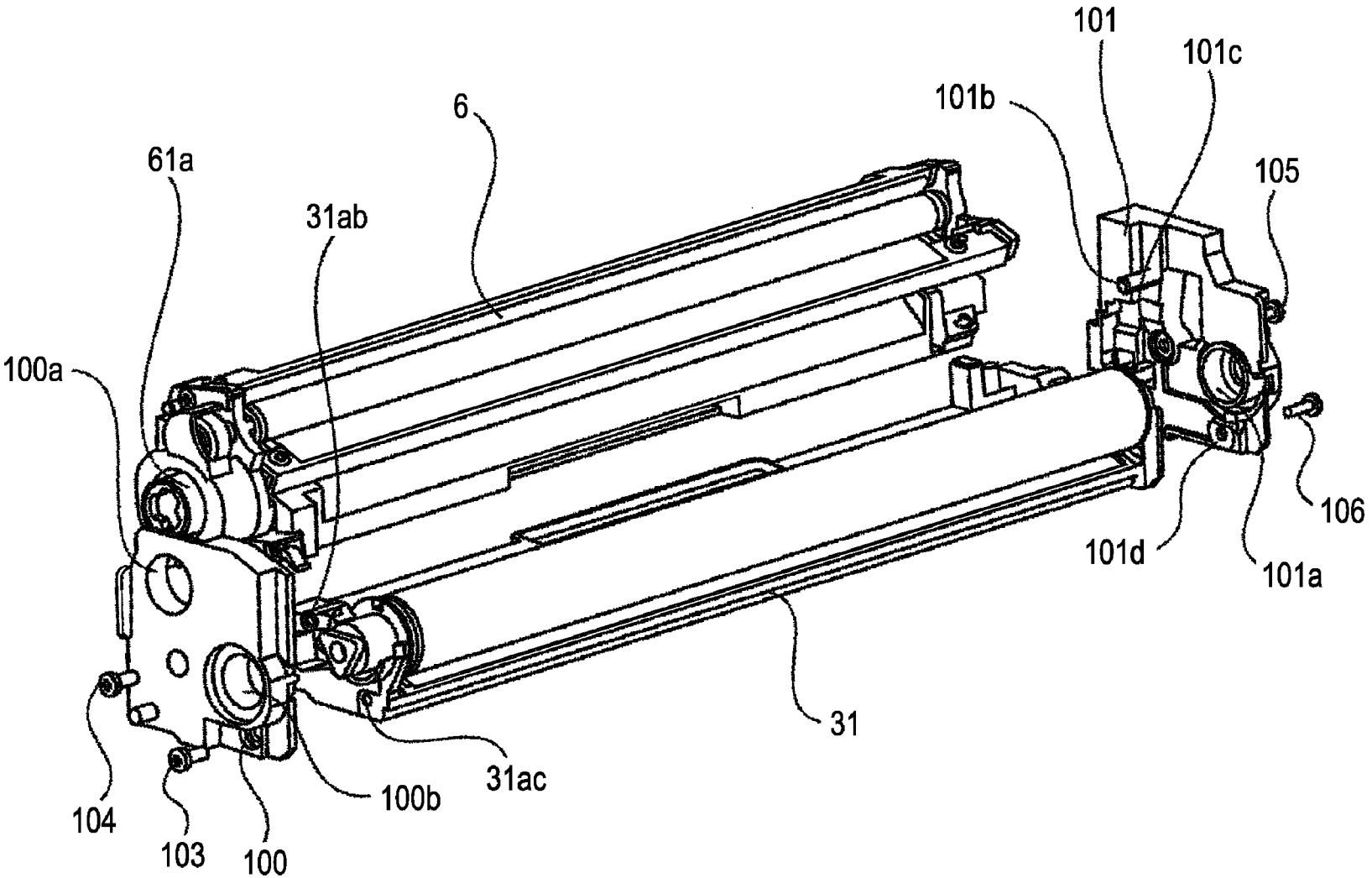
FIG. 7 is an exploded perspective view showing the overall configuration of the process cartridge.
Figure 8:
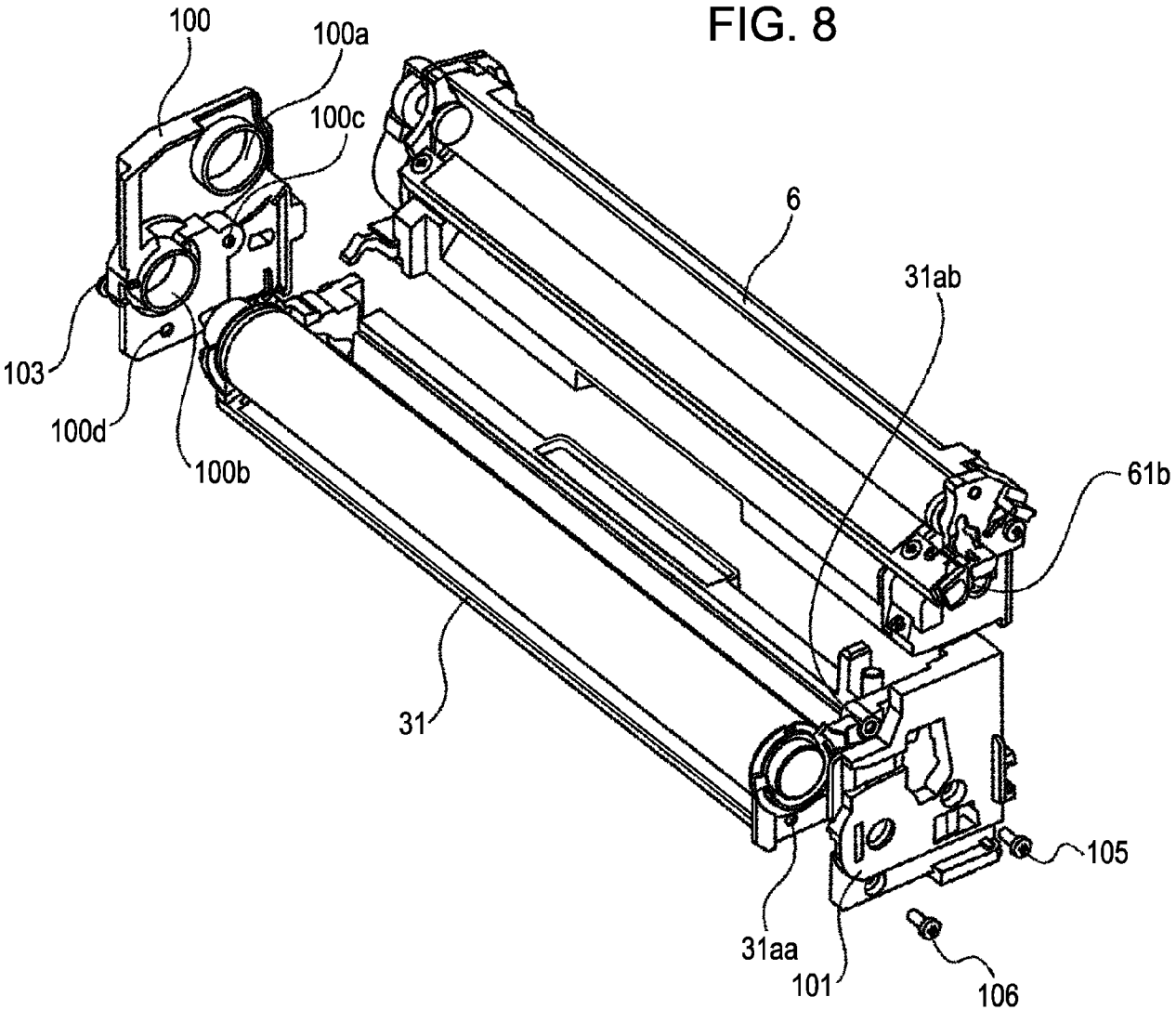
FIG. 8 is another exploded perspective view showing the overall configuration of the process cartridge.

A unit disassembling step in which the process cartridge P is disassembled into the cleaner unit 31 and the developer unit 6 will be described with reference to FIGS. 7 and 8.

The cleaner unit 31 and the developer unit 6 are rotatably coupled together by main side covers 100 and 101. The main side covers 100 and 101 are secured to the cleaner case 31*a* with screws 103, 104, 105, and 106.

Therefore, the screws 103 to 106 securing the main side covers 100 and 101 to the cleaner case 31*a* are first removed. Subsequently, the main side covers 100 and 101 are slid in the longitudinal direction of the process cartridge P, whereby the cleaner unit 31 and the developer unit 6 can be disassembled from each other.

FIG. 9 is a schematic perspective view of the developer unit 6 after the disassembling.

Developer Unit Disassembling Steps

Steps of disassembling the developer unit 6 will be described in due order, with reference to FIGS. 10 and 11.

First, a step of removing the nondrive-side bearing 110 from the developer unit 6 will be described. In this step, the nondrive-side bearing 110 is removed by removing a screw 111.

Referring to FIG. 10, the developer unit 6 has on the nondrive side thereof the bearing 110 secured to the developer case 6*e* with the screw 111. Therefore, the bearing 110 can be removed by removing the screw 111.

Next, a step of removing the developing roller 6*a* will be described with reference to FIGS. 9 to 11. In this step, the developing roller 6*a* is removed from the developer unit 6.

As can be seen from FIGS. 9 to 11, the developing roller 6*a* is rotatably supported, on the drive side, by the bearing 140 with the drive-side shaft 6*a* b thereof fitted in the hole 140*a*. Further, on the outer side with respect to the bearing 140 in the longitudinal direction of the developing roller 6*a*, the end, as a fitted portion, of the drive-side shaft 6*ab* is fitted in a D-shaped hole 142*a*, as an engaging portion (a receiving portion), of a gear 142, as a driving force transmitter, with a predetermined phase relationship. On the nondrive side, the developing roller 6*a* is rotatably supported by the bearing 110 with the nondrive-side shaft 6*a* a thereof fitted in the hole 110*a*. First, the bearing 110 is removed from the developer case 6*e*, whereby the nondrive-side shaft 6*aa* retracts from the hole 110*a*. Subsequently, the developing roller 6*a* is pulled out toward the nondrive side, whereby the developing roller 6*a* is removed from the developer case 6*e* (a developing-roller-removing step). Thus, the drive-side shaft 6*ab* is released from the hole 140*a*. Meanwhile, with the bearing 140 and the side cover 141 staying on the developer unit 6, the gear 142 rests on a resting portion 141*a* of the side cover 141 (a resting step).

Next, a step of removing the toner-amount-regulating member 6*c* from the developer unit 6 will be described with reference to FIG. 12. In this step, the toner-amount-regulating member 6*c* is removed by removing the screws 120 and 121.

Referring to FIG. 12, the toner-amount-regulating member 6*c* is temporarily positioned by a toner-amount-regulating-member-positioning projection 6*e* a provided on the developer case 6*e*, and is secured to the developer case 6*e* with the screws 120 and 121. Therefore, after the screws 120 and 121 are removed, the toner-amount-regulating member 6*c* can be removed.

Through the steps described above, disassembling of the developer unit 6 can be finished. In this state, the toner filling opening 6*m* of the developer unit 6 is exposed, enabling filling of toner into the developer case 6*e*. Since toner can be filled into the developer case 6*e* with the side cover 141, the bearing 140, and the drive-side gears (including the gear 142) staying on the developer unit 6, the developer unit 6 can be disassembled and reassembled more easily.

Toner Filling Step

Figure 13:
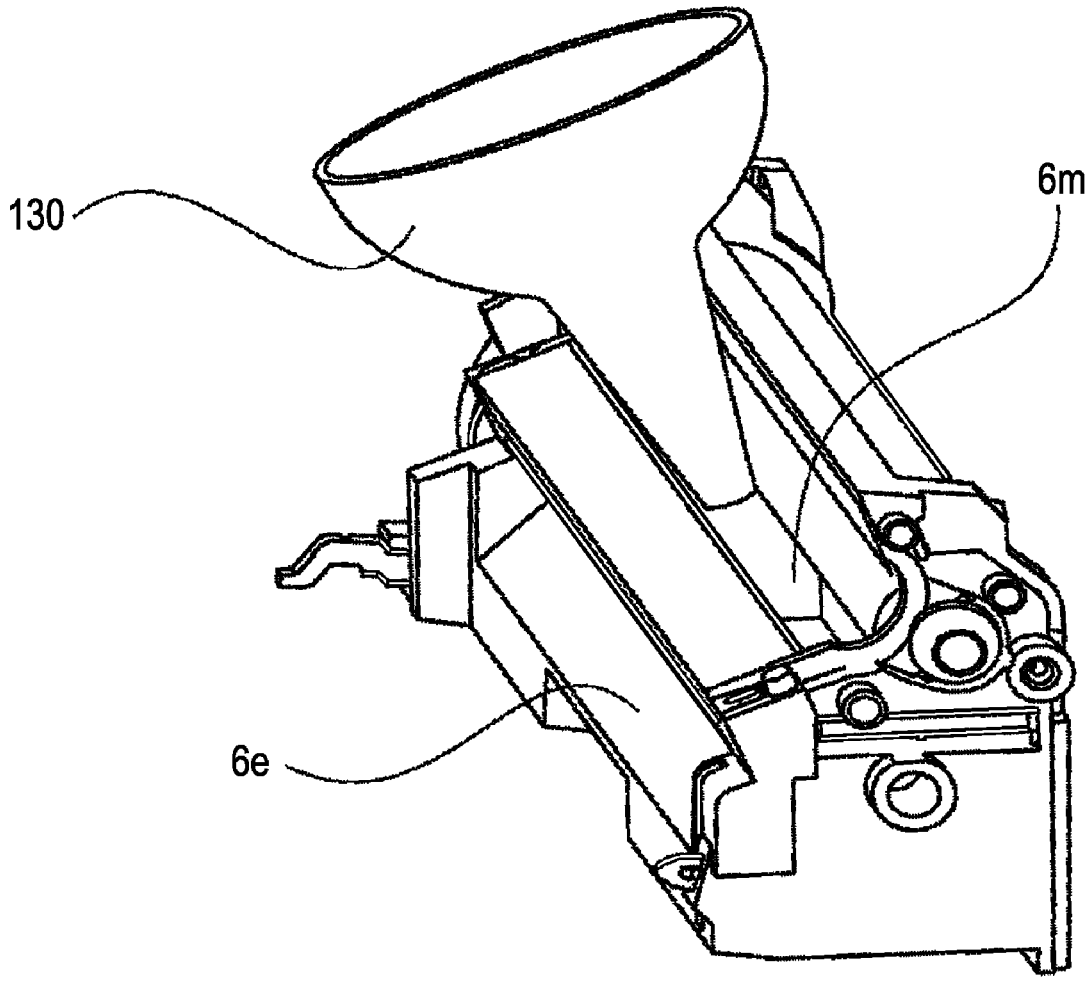
FIG. 13 is a schematic perspective view for describing a toner filling step.

Next, a toner filling step will be described with reference to FIG. 13.

In this step, toner is filled into the developer case 6*e* through the toner filling opening 6*m* that has been exposed by removing the toner-amount-regulating member 6*c*.

Specifically, toner is filled into the developer case 6*e* by placing the tip of a funnel 130 into the toner filling opening 6*m* and pouring toner from a toner bottle or the like (not shown) into the funnel 130. If a volumetric feeder having an auger thereinside is used as the funnel 130, toner can be filled efficiently.

Figure 14:
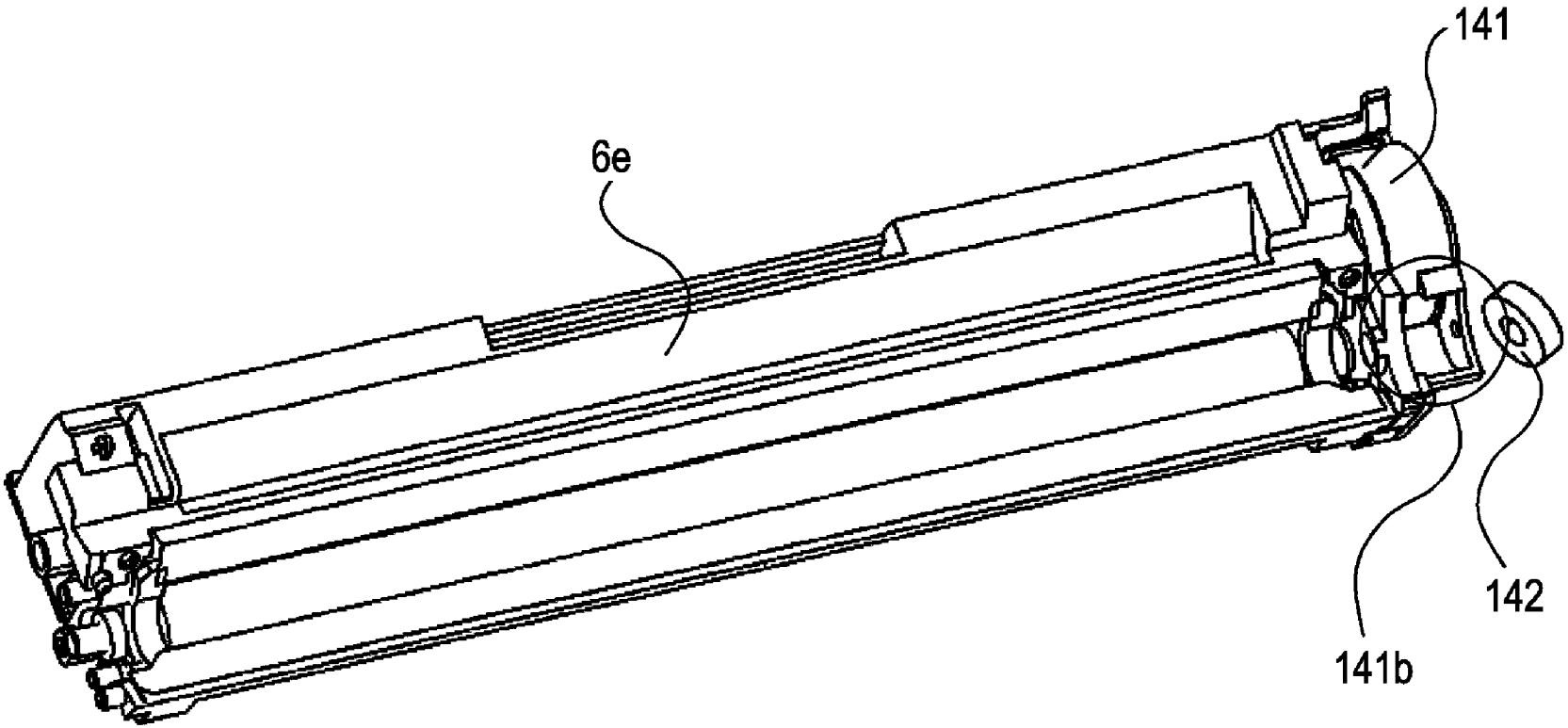
FIG. 14 is an exploded perspective view showing how a gear is disassembled from the developer unit.

Referring to FIG. 14, the gear 142 can be solely removed from an exposed portion 141*b* of the side cover 141. If the gear 142 is solely removed before performing the toner filling step and the exposed portion 141*b* is covered with a covering member such as a piece of adhesive tape, the gear 142 and the interior of the side cover 141 can be protected from contamination due to splattering, for example, of the toner during the toner filling step.

Developer Unit Reassembling Steps

After filling toner into the developer case 6*e* as described above, the process cartridge P is reassembled. To reassemble the process cartridge P, the disassembling steps are performed in the reverse order. Steps of reassembling the developer unit 6 will be described in due order.

First, a step of attaching the toner-amount-regulating member 6*c* will be described with reference to FIG. 12. In this step, the toner-amount-regulating member 6*c* is attached to the developer case 6*e*.

Specifically, a notch 6*c* a provided at the nondrive-side end of the toner-amount-regulating member 6*c* is made to engage with the toner-amount-regulating-member-positioning projection 6*ea* provided on the developer case 6*e*, whereby the toner-amount-regulating member 6*c* is positioned temporarily. Subsequently, the screws 120 and 121 are inserted through screw through holes 6*cb* and 6*cc* and screwed into the toner-amount-regulating-member-securing holes 6*ed* and 6*ee* provided in the toner-amount-regulating-member-bearing surfaces 6*eb* and 6*ec* of the developer case 6*e*.

Figure 15A:
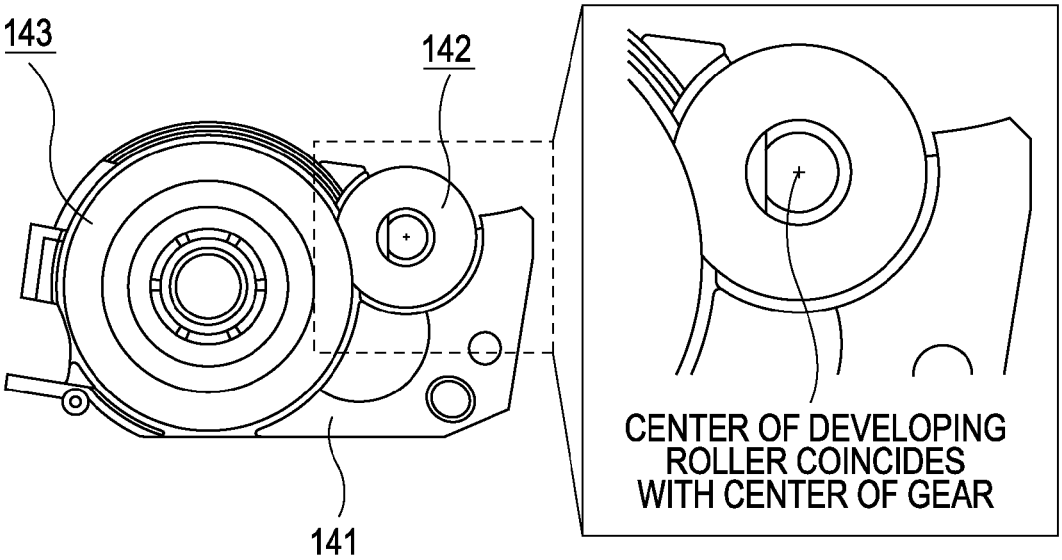
FIGS. 15A and 15B show positions of the gear after and before attaching the developing roller, respectively.
Figure 15B:
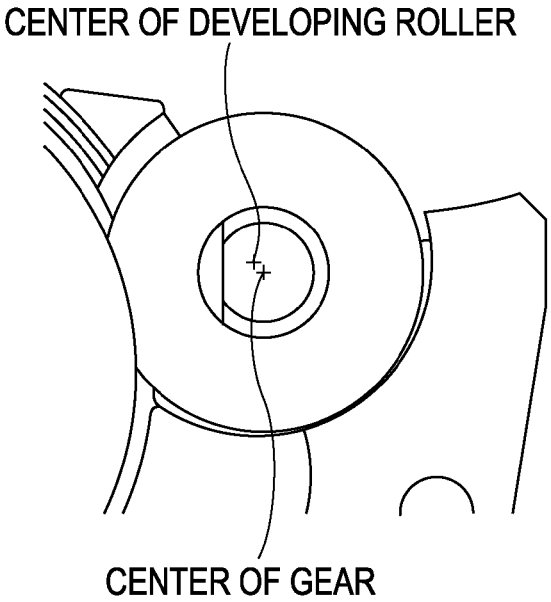

Next, a step of attaching the developing roller 6*a* will be described with reference to FIGS. 10 and 11. If the gear 142 has been removed prior to this step, the gear 142 is first placed into the side cover 141 through the exposed portion 141*b*. In this step, referring to FIG. 15B, the gear 142 rests on the resting portion 141*a* of the side cover 141 in such a manner that the center of the gear 142 is positioned near a position corresponding to the center of the developing roller 6*a*, which is to be fitted thereto. Specifically, with the side cover 141 staying on the developer case 6*e*, the gear 142 rests on the side cover 141 (the resting step) in such a manner that, when seen in the longitudinal direction of the developing roller 6*a*, the hole 140*a* and the D-shaped hole 142*a* overlap each other at least partially. Thus, the drive-side shaft 6*a* b can be easily made to engage with both the hole 140*a* and the D-shaped hole 142*a* in an engaging step described below. After the resting step, the drive-side shaft 6*a* b of the developing roller 6*a* is inserted through the hole 140*a* in the bearing 140 attached to the developer case 6*e* (an inserting step). Further, the drive-side shaft 6*a* b of the developing roller 6*a* is moved so as to project outside of the bearing 140 and to be fitted into (to engage with) the D-shaped hole 142*a*, whereby the state shown in FIG. 15A is resumed, where the gear 142 is not supported by the side cover 141 (the engaging step). Subsequently, the nondrive-side shaft 6*aa* of the developing roller 6*a* is fitted into the hole 110*a* in the bearing 110, and the bearing 110 is attached to the developer case 6*e*.

In fitting (engaging) the drive-side shaft 6*ab* of the developing roller 6*a* into the D-shaped hole 142*a* of the gear 142, the phases thereof can be matched by rotating the gear 142, exposed in the exposed portion 141*b* of the side cover 141, relative to the drive-side shaft 6*ab*. Moreover, since the drive-side shaft 6*ab* and the D-shaped hole 142*a* can be observed through the exposed portion 141*b* of the side cover 141, the developing roller 6*a* can be attached by checking the phase relationship between the drive-side shaft 6*ab* and the gear 142. The developing roller 6*a* to be reassembled into the developer unit 6 may be either the one that has been included in the developer unit 6 before the disassembling, or another one. In this state, a gear 143, which is in engagement with the gear 142, receives a driving force applied by a relevant element in the body 1A and transmits the driving force to the gear 142.

In attaching the bearing 110 to the developer case 6*e*, a positioning projection (not shown) provided on the developer case 6*e* is fitted into a positioning hole (not shown) provided in the bearing 110, whereby the bearing 110 is positioned. Subsequently, the screw 111 is inserted through a screw through hole 110*c* and is screwed into a developing-roller-shaft-securing hole (not shown) provided in the developer case 6*e*.

Through the steps described above, the reassembling of the developer unit 6 can be finished. According to the embodiment, since there is no need to remove the side cover 141, the process cartridge P can be reassembled more easily. In addition, since toner can be filled into the developer unit 6 without removing the gears provided on the drive side, the developer unit 6 can be disassembled and reassembled more easily.

Unit Coupling Step

Next, a unit coupling step in which the developer unit 6 that has been reassembled and the cleaner unit 31 are coupled to each other will be described with reference to FIG. 7. In this step, the cleaner unit 31 and the developer unit 6 are rotatably coupled to each other.

In this step, the combination of the cleaner unit 31 and the developer unit 6 may be either the same as or different from the combination before the unit disassembling step.

A fitting shaft 61*a* of the developer unit 6 and a nondrive-side shaft of the cleaner unit 31 are fitted into a fitting hole 100*a* and a fitting hole 100*b*, respectively, of the main side cover 100, whereby the main side cover 100 is attached to the cleaner case 31*a*. Further, a fitting shaft 101*b* of the main side cover 101 is fitted into a fitting hole 61*b* of the developer unit 6, and a drive-side shaft of the cleaner unit 31 is fitted into a fitting hole 101*a* of the main side cover 101, whereby the main side cover 101 is attached to the cleaner case 31*a*. The order of attaching the main side covers 100 and 101 is arbitrary. The main side covers 100 and 101 may be attached simultaneously. Thus, the cleaner unit 31 and the developer unit 6 can be rotatably coupled to each other.

Subsequently, the screws 103 and 104 are inserted through respective screw through holes 100*d* and 100*c* of the main side cover 100 and are screwed into respective securing holes 31*a* c and 31*ab* of the cleaner case 31*a*. Further, the screws 105 and 106 are inserted through respective screw through holes 101*c* and 101*d* of the main side cover 101 and are screwed into respective securing holes 31*ab* and 31*aa* of the cleaner case 31*a*. The order of screw securing is arbitrary. The foregoing elements may be secured with the screws simultaneously. Thus, the main side covers 100 and 101 can be secured to the cleaner case 31*a*.

Through the steps described above, assembling (reassembling) of the process cartridge P can be finished.

According to the embodiment, an easier cartridge assembling method and cartridge reassembling method can be provided.

While the present invention has been described with reference to exemplary embodiments, it is to be understood that the invention is not limited to the disclosed exemplary embodiments. The scope of the following claims is to be accorded the broadest interpretation so as to encompass all modifications and equivalent structures and functions.

This application claims the benefit of Japanese Patent Application No. 2008-086958 filed Mar. 28, 2008, and No. 2009-015417 filed Jan. 27, 2009, which are hereby incorporated by reference herein in their entirety.

What is claimed is:

1. A method of assembling a cartridge attachable to and removable from a body of an image forming apparatus, the cartridge including a developer case having an opening, a rotatable developing roller disposed in the opening and configured to develop a latent image formed on an image bearing member, a bearing disposed on an outer side with respect to the developer case in a longitudinal direction of the developing roller and configured to bear a shaft of the developing roller allowing rotation thereof, a driving force transmitter disposed on the outer side with respect to the bearing in the longitudinal direction and having an engaging portion configured to engage with the shaft of the developing roller so that a force for rotating the developing roller is transmitted to the developing roller, and an end member disposed on the outer side with respect to the bearing in the longitudinal direction, the method comprising:

resting the driving force transmitter on the end member, the end member staying on the developer case;

inserting the shaft of the developing roller into the bearing so that the shaft of the developing roller is supported by the bearing; and engaging the shaft of the developing roller with the driving force transmitter after moving the shaft of the developing roller toward the outer side with respect to the bearing in the longitudinal direction and releasing the driving force transmitter that has been rested on the end member from the end member.

2. The method according to claim 1, wherein the resting of the driving force transmitter on the end member is performed in such a manner that, when seen in the longitudinal direction, a hole provided in the bearing and a hole provided in the engaging portion overlap each other at least partially.

3. The method according to claim 1, wherein the engaging is performed in such a manner that the driving force transmitter resting on the end member is rotated, whereby the engaging portion and the shaft of the developing roller are made to engage with each other with a predetermined phase relationship.

4. The method according to claim 1, wherein the end member has an exposed portion in which the engaging portion and the shaft of the developing roller are exposed so that the phase relationship therebetween is externally observable during the engaging.

5. A method of reassembling a cartridge attachable to and removable from a body of an image forming apparatus, the cartridge including a developer case having an opening, a rotatable developing roller disposed in the opening and configured to develop a latent image formed on an image bearing member, a bearing disposed on an outer side with respect to the developer case in a longitudinal direction of the developing roller and configured to bear a shaft of the developing roller allowing rotation thereof, a driving force transmitter disposed on the outer side with respect to the bearing in the longitudinal direction and having an engaging portion configured to engage with the shaft of the developing roller so that a force for rotating the developing roller is transmitted to the developing roller, and an end member disposed on the outer side with respect to the bearing in the longitudinal direction, the method comprising:

removing the shaft of the developing roller from the bearing with the end member staying on the developer case;

resting the driving force transmitter on the end member, the end member staying on the developer case;

inserting the shaft of the developing roller or a shaft of another developing roller into the bearing so that the shaft of the developing roller or the shaft of the another developing roller is supported by the bearing; and engaging the shaft of the developing roller or the shaft of the another developing roller with the driving force transmitter after moving the shaft of the developing roller or the shaft of the another developing roller toward the outer side with respect to the bearing in the longitudinal direction and releasing the driving force transmitter that has been rested on the end member from the end member.

6. The method according to claim 5, wherein the resting of the driving force transmitter on the end member is performed in such a manner that, when seen in the longitudinal direction, a hole provided in the bearing and a hole provided in the engaging portion overlap each other at least partially.

7. The method according to claim 5, wherein the engaging is performed in such a manner that the driving force transmitter resting on the end member is rotated, whereby the engaging portion and the shaft of the developing roller or the shaft of the another developing roller are made to engage with each other with a predetermined phase relationship.

8. The method according to claim 5, wherein the end member has an exposed portion in which the engaging portion and the shaft of the developing roller or the shaft of the another developing roller are exposed so that the phase relationship therebetween is externally observable during the engaging.

9. The method according to claim 5, further comprising, after the removing and before the inserting:

filling toner into the developer case through the opening.

10. The method according to claim 9, wherein the filling of the toner into the developer case through the opening is performed in a state where the driving force transmitter is removed from between the end member and the bearing.

11. The method according to claim 10, wherein the filling of the toner into the developer case through the opening is performed in a state where a space between the end member and the bearing is covered with a covering member so as to prevent the toner from entering the space.

* * * * *